United States Patent [19]

Port et al.

[11] Patent Number: 4,624,700

[45] Date of Patent: Nov. 25, 1986

[54] METHOD FOR CONTROLLING THE OXYGEN CONTENT IN AGGLOMERATED MOLYBDENUM POWDERS

[75] Inventors: David J. Port, Sayre; David L. Houck, Towanda; Frank D. Kinney, Wyalusing, all of Pa.

[73] Assignee: GTE Products Corporation, Stamford, Conn.

[21] Appl. No.: 831,201

[22] Filed: Feb. 20, 1986

[51] Int. Cl.[4] ..... B22F 9/00

[52] U.S. Cl. ..... 75/0.5 BB

[58] Field of Search ..... 75/0.5 BB, 0.5 BC

[56] References Cited

U.S. PATENT DOCUMENTS

| | | | |
|---|---|---|---|
| 3,407,057 | 10/1968 | Timmons | 75/0.5 BB |
| 3,881,911 | 5/1975 | Cheney et al. | 75/0.5 BB |
| 3,909,241 | 9/1975 | Cheney et al. | 75/0.5 BB |
| 3,973,948 | 8/1976 | Laferty, Jr. et al. | 75/0.5 BB |
| 4,146,388 | 3/1979 | Lafferty | 75/0.5 BB |

*Primary Examiner*—Wayland Stallard

*Attorney, Agent, or Firm*—Donald R. Castle; L. Rita Quatrini

[57] ABSTRACT

A method is disclosed for introducing a controlled level of oxygen into agglomerated molybdenum plasma spray powder. The method involves forming a relatively uniform mixture of agglomerated powders consisting essentially of molybdenum and one or more oxygen containing compounds of molybdenum wherein said mixture has an oxygen content of greater than about 10% by weight and reducing the mixture at a sufficient temperature for a sufficient time to remove a portion of the oxygen therefrom and form a molybdenum powder having an oxygen content of no greater than about 10% by weight.

4 Claims, No Drawings

METHOD FOR CONTROLLING THE OXYGEN CONTENT IN AGGLOMERATED MOLYBDENUM POWDERS

BACKGROUND OF THE INVENTION

This invention relates to a method controlling the oxygen content of agglomerated molybdenum powders by controlled oxidation of the powders. More particularly it relates to a method of introducing a controlled amount of oxygen into agglomerated molybdenum powders by reducing powders of molybdenum and oxides of molybdenum.

Flame spraying and plasma spraying are common techniques for the application of protective and wear resistant coatings of various metals, ceramics, and cermets, usually to metal surfaces (substrates). The piston ring industry commonly uses molybdenum coatings on rings for internal combustion engines.

In the flame spraying technique an electric arc or an oxyacetylene flame melts the end of a continuous coil of molybdenum wire and a gas propels it onto a substrate for example, the wear surface of a cast iron piston ring where it splats and solidifies, forming the coating in successive layers. Because of the presence of excess oxygen either from the flame or the surrounding air, or both, the coatings produced by this technique contain large quantities of oxygen, typically from about 7% to about 8% in solution and as various molybdenum oxides. The large quantities of oxygen in the molybdenum apparently harden the coating.

In the plasma spraying of molybdenum, there is usually a minumum of oxygen in the sprayed coating due to the use of an oxygen-lean plasma gas system. That is, argon, helium, hydrogen, nitrogen, or combinations of these gases, all of which are relatively free from oxygen, are used in the plasma spraying process. Hence, any oxygen in the sprayed coating is incidentally due to oxidation of the molten particles by oxygen impurity in the plasma gas and/or surface oxidation of the freshly deposited coating. In such "pure" molybdenum coatings the oxygen level is in the 1% to 2% range. Such coatings are softer than their flame sprayed counterparts.

For higher hardness, therefore, a more expensive process such as the flame spray process which requires wire, or a more expensive powder such as molybdenum plus nickel-base alloy must be used.

It would be desirable therefore to have a method of producing molybdneum powders of sufficiently high oxygen content to enable them to be used in a plasma spray process to produce hard coatings.

U.S. Pat. No. 4,146,388 describes and claims molybdenum plasma spray powders and a process for producing the powders of molybdenum and oxides of molybdenum having an oxygen content of from about 0.5 to about 15% by weight oxygen. The process involves passing molybdenum particles through a plasma with oxygen or oxides of molybdenum to produce the oxidized powder.

SUMMARY OF THE INVENTION

In accordance with one aspect of this invention, there is provided a method for introducing a controlled level of oxygen into agglomerated molybdenum plasma spray powder. The method involves forming a relatively uniform mixture of agglomerated powders consisting essentially of molybdenum and one or more oxygen containing compounds of molybdenum wherein the mixture has an oxygen content of greater than about 10% by weight and reducing the mixture at a sufficient temperature for a sufficient time to remove a portion of the oxygen therefrom and form a molybdenum powder having an oxygen content of no greater than about 10% by weight.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

U.S. Pat. No. 4,146,388 discloses a process for producing molybdenum spray powders containing oxygen by the plasma melting process or in conjunction with the plasma melting process. By the process of this invention the oxygen level in molybdenum powders is controlled in preparation for plasma coating applications.

In the particular applications in which the controlled oxygen molybdenum powders resulting from the method of this invention are preferably used, that is, in plasma spray applications to produce plasma spray coatings, the desired oxygen content is typically no greater than about 10% and most preferably from about 7% to about 10% by weight. At levels lower than this, the hardness of the plasma coating is not improved. At levels higher than this range, coating integrity or bond strength is compromised.

The oxygen containing compounds of molybdenum can be molybdenum dioxide, molybdenum trioxide, or ammonium paramolybdate.

It is to be understood that any mixture of molybdenum and oxygen containing compounds of molybdenum can be used as long as the oxygen content of the agglomerated mixture is greater than about 10% by weight.

A typical composition of the mixture of molybdenum powders to be agglomerated consists essentially of in percent by weight about 40% molybdenum, about 50% molybdenum dioxide, and about 10% molybdenum trioxide with the oxygen content being about 15.8% by weight.

The mixture of molybdenum and the oxygen containing compound or compounds can be agglomerated by any of several methods well know in the art.

One preferred method involves generally forming a slurry of water, ammonia or ammonium hydroxide, molybdenum trioxide, molybdenum dioxide, and ultrafine (about 1 to 3 microns in diameter) molybdenum particles. Ammonium paramolybdate is formed from the molybdenum trioxide and ammonium hydroxide and acts as the binder in this system. The resulting slurry is then spray dried to remove the water and form the relatively uniform agglomerated mixture which consists of essentially spherical particles. The above method of forming the agglomerated mixture is described in U.S. Pat. No. 3,973,948 which is hereby incorporated by reference.

Another method of forming the relatively uniform agglomertated mixture is by first forming a slurry as described above. The water is allowed to evaporate while the slurry is being continually stirred to break up the material. The resultant coarse moist powder is then forced through a 100 mesh screen and collected. The powder is then further dried with gentle agitation. The final agglomerated mixture is then screened from this dried mixture.

Some preferred methods of agglomerating the molybdenum powder are disclosed also in a paper entitled "Properties of Oxygen Bearing Molybdenum Coatings," published in the proceedings of the Ninth International Thermal Spray Conference, Denhaag, Netherlands, May 19–23, 1980.

The resulting agglomerated mixture is then reduced at a sufficient temperature for a sufficient time to remove a portion of the oxygen and form a molybdenum powder having an oxygen content of no greater than about 10% and preferably from about 7% to about 10% by weight.

The reduction can be done in a standard furnace in a dry hydrogen atmosphere. The preferred tempratures are from about 700° C. to about 1000° C. The time depends on the temperature and on the nature of the equipment. However, typical times are from about 2 hours to about 4 hours.

The reduction can be done in a fluidized bed or rotary calciner. The reducing conditions are adjusted to give the final desired oxygen content. The advantages of using a fluidized bed or rotary calciner over the above described static bed reduction are that a bed depth problem is avoided resulting in a more uniform reduction than in the static bed furnace. In a fluidized bed or rotary calciner the reduction of the agglomerates takes place from the outside of the agglomerates to the inside resulting in the metal phase being on the outside of the agglomerates. This results in a more efficient melting of the agglomerates in the plasma application and therefore produces a harder coating.

The resulting powders with controlled oxygen levels are used in plasma spraying applications to produce coatings such as on piston rings.

To more fully illustrate this invention, the following non-limiting example is presented. All parts, portions, and percentages are on a weight basis unless otherwise stated.

EXAMPLE

An aqueous slurry is made up consisting essentially of about 85% solids, the solids consisting essentially of about 11% molybdenum trioxide, about 52% molybdenum dioxide, and about 36% molybdenum, the oxygen content of the solids being about 16.6%, and ammonia in an amount equal to about 87% of the molybdenum trioxide. The slurry is dried in a conventional dryer to produce a relatively uniform aggomerated mixture consisting of particles which are essentially spherical in shape. The mixture is reduced in dry hydrogen at about 800° C. for about 2 hours resulting in a free-flowing molybdenum spray powder having an oxygen content of from about 7% to about 8%.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for introducing a controlled level of oxygen into agglomerated molybdenum plasma spray powder, said method comprising:

(a) forming a relatively uniform mixture of agglomerated powders consisting essentially of molybdenum, and one or more oxygen containing compounds of molybdenum wherein said mixture has an oxygen content of greater than about 10% by weight; and (b) reducing said mixture at a sufficient temperature for a sufficient time to remove a portion of the oxygen therefrom and form a molybdenum powder having an oxygen content of no greater than about 10% by weight.

2. A method of claim 1 wherein said mixture consists essentially of molybdenum, ammonium paramolybdate, and molybdenum oxides.

3. A method of claim 1 wherein the reducing temperature is from about 700° C. to about 1000° C.

4. A method of claim 3 wherein the oxygen content of the reduced molybdenum powder is from about 7% to about 10% by weight.

* * * * *